United States Patent [19]

Helffer et al.

[11] 4,299,179

[45] Nov. 10, 1981

[54] METHOD AND INSTALLATION FOR SUPPLYING A SEWING MACHINE

[75] Inventors: Bernard Helffer, Saint André-les-Vergers; Jean-Pierre Raisin, Troyes, both of France

[73] Assignee: Agence Nationale de Valorisation de la Recherche (ANVAR), France

[21] Appl. No.: 901,111

[22] Filed: Apr. 28, 1978

[30] Foreign Application Priority Data

May 11, 1977 [FR] France ..... 77 14408

[51] Int. Cl.[3] ..... D05B 33/00; D05B 81/00

[52] U.S. Cl. ..... 112/121.12; 112/262.3; 112/311; 271/268

[58] Field of Search ..... 112/311, 121.29, 121.12, 112/121.15, 121.11, 262.3, 102, 103, 121.14; 223/2; 271/277, 268, 85; 156/538, 539, 556

[56] References Cited

U.S. PATENT DOCUMENTS

| | | | |
|---|---|---|---|
| 3,713,408 | 1/1973 | Deeks et al. | 112/121.15 |
| 3,727,567 | 4/1973 | Beazley | 112/121.11 |
| 3,742,878 | 7/1973 | Byrne et al. | 112/121.12 |
| 3,769,924 | 11/1973 | Rogers et al. | 112/121.29 |
| 3,789,781 | 2/1974 | Carson et al. | 112/121.12 X |
| 3,799,086 | 3/1974 | Block | 112/121.15 |
| 3,869,998 | 3/1975 | Scholl | 112/121.15 |
| 3,884,167 | 5/1975 | Bernewasser et al. | 112/121.29 |
| 4,006,698 | 2/1977 | Scholl et al. | 112/121.11 |
| 4,157,692 | 6/1979 | Brocklehurst | 112/262.3 |

FOREIGN PATENT DOCUMENTS 2147392 4/1971 Fed. Rep. of Germany .

*Primary Examiner*—Werner H. Schroeder
*Assistant Examiner*—Andrew M. Falik
*Attorney, Agent, or Firm*—Poms, Smith, Lande & Rose

[57] ABSTRACT

The present invention relates to a method and installation for supplying a machine for linear treatment such as a sewing machine for joining flexible elements such as textile pieces, said method comprising the steps of gripping at least one flexible element by a gripping zone thereof and placing and maintaining this gripping zone at a predetermined fixed spot by means of a first gripping device (fixed clips); gripping the flexible element by said gripping zone thus positioned by means of a second gripping device (carriage provided with clips); displacing the flexible element by means of the second gripping device up to driver members of the machine for linear treatment.

10 Claims, 9 Drawing Figures

METHOD AND INSTALLATION FOR SUPPLYING A SEWING MACHINE

BACKGROUND OF THE INVENTION

The present invention relates to a method and installation for supplying a machine for linear treatment, such as a sewing machine.

The invention relates more particularly, but not exclusively, to a method for supplying a machine for joining flexible elements such as textile pieces, of the type according to which at least two elements to be joined are gripped, these elements are prepositioned with respect to each other and are provisionally joined at a predetermined fixed spot, by superposing them at least partially so that a predetermined, so-called joined zone of one of said elements is superposed with a predetermined joining zone of the other element, then said provisionally joined elements are transferred to the joining machine and said elements are definitively joined by means of said joining machine where said flexible elements are joined by said joining zones.

The supply of an automatic joining machine generally consists in taking two elements to be joined, in adjusting them edge to edge and in presenting them, correctly positioned, to a drive device provided at the inlet of the joining machine. These operations must preferably succeed one another without time wasted for the operator.

In prior art devices, the elements are gripped by devices intimately associated with the joining apparatus. That is, an operator aligns the elements and then begins the joining operation. Until the joining is complete or well under way, the operator cannot begin aligning elements for the next joining operation. The joining operation for the next element is thus, delayed while the operator positions the elements in the intimate gripping device. It would be desirable, though not possible with prior art devices, to make it possible for the operator to align the next to be joined elements in a manner which would virtually eliminate this wasted time and thereby increase the productivity of the joining machine.

Accordingly, the objects of the present invention are:

(1) to transfer the two elements to be joined from an operator's hands to a joining machine as soon as the operator has positioned the elements to define the joining zone and to do so without disturbing that position;

(2) to facilitate mutual adjustment of the two elements to be joined and (3) to transfer, in precise position, to the drive device of the joining machine, the adjusted elements without modifying their adjustment with respect to each other.

SUMMARY OF THE INVENTION

The present invention, in a broad aspect, provides an apparatus between a sewing (or joining) machine, and an operator, which transfers two partially overlapping pieces of fabric from the operator's hands to the sewing machine as soon as the operator has assembled the fabric pieces in the relationship to be made permanent by the sewing. Accordingly, the previous need for the operator to assemble the fabric pieces in a certain relationship and to manually transport the assembled pieces to the sewing machine, while maintaining that relationship, is eliminated.

More particularly, the apparatus only requires the operator to assemble the two pieces of material to be sewn and to position the pieces vertically in front of her. A first gripping device, which comprises a plurality of downwardly-oriented clips on a horizontally-disposed crossbar movable vertically between two supports, takes the pieces from the operator's hands and moves them to a position above the operator.

When the first gripping device has so transported the fabric, a second gripping device, which comprises a second plurality of clips on a platform adapted for rotative and translative movement, rotates toward the first gripping device and latches onto the fabric pieces. At this time, the first gripping device releases the fabric and moves slightly upward to allow the second gripping device to rotate, with the attached fabric, away from the first gripping device. The first gripping device then moves back down toward the operator to take two more pieces from the operator. Meanwhile, the second gripping device moves the transfer or drive portion of the sewing machine, which comprises a table disposed between the platform and the clips, and two pneumatically operated presser bars cooperating with a feed dog.

The presser bars are initially positioned off the table thereby allowing the clips of the second gripping device to drag the material along the table and under the presser bars. When this has occurred, the presser bars move toward the table and engage the fabric. The clips then release the fabric and the second gripping device moves away from the table to get another two pieces of fabric from the first gripping device. As this is occurring, the feed dogs move the previously-released fabric to the sewing machine.

The invention will be more readily understood on reading the following description with reference to the accompanying drawings, in which:

DETAILED DESCRIPTION

Figure 1:
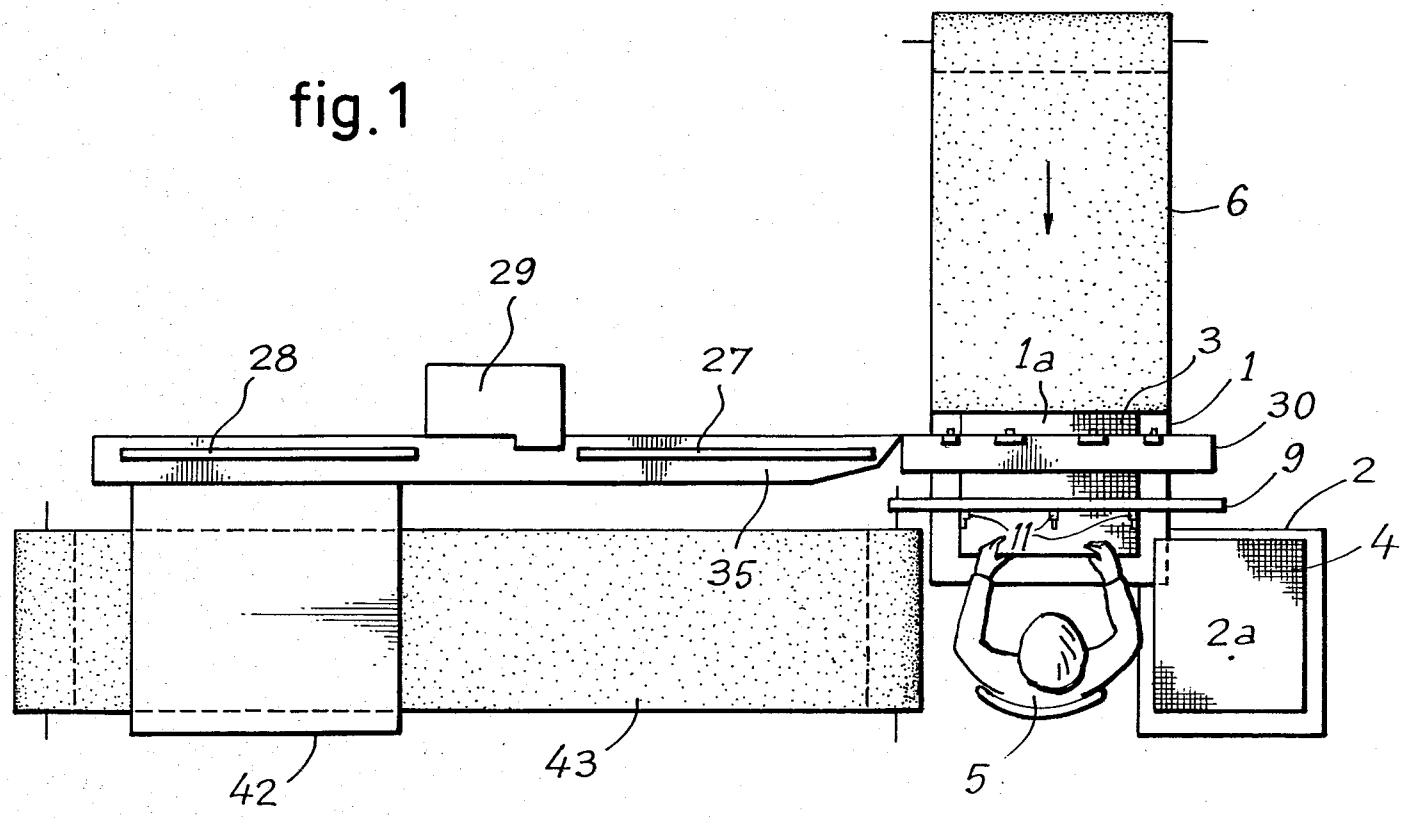
FIG. 1 is a plan view of the supply installation of a joining machine according to one embodiment of the invention.

Referring to the drawings, the installation shown comprises a work station, a preparation device and a transfer device.

The work station has been studied so that the operator's gestures are reduced to a minimum. This station comprises supports 1 and 2 for stacks 1*a* and 2*a* of pieces of fabric 3, 4 for example rectangular in shape, to be joined, as well as means for supplying these stacks 1*a*, 2*a* with textile pieces 3, 4 such as pieces of woven or non-woven fabrics.

One of the supports 1 is a main table located in front of the operator 5 beneath supply means which will be described hereinafter. The height of this table 1 is adjustable as a function of the operator's size and the height of the stack 1*a* of elements to be joined. With this table 1 is associated a system of supplying the stacks 1*a*, 2*a* of elements to be joined; according to the example shown, this system is a conveyor belt 6. This system enables the time given to supplying the working station to be reduced, the operator no longer having to leave his/her post to collect the elements to be joined.

To facilitate gripping of the second element to be joined taken from stack 2*a*, and to avoid said element covering the stack 1*a* of the first elements during transfer, this second stack 2*a* is disposed on a table 2 located perpendicularly to and to the right of the table 1 as shown in FIG. 1. This table 2 is also adjustable in height.

To the left of the operator is located a conveyor 43 which allows the return to the operator of the stacks of joined elements for the execution of a second operation on the same elements.

Figure 3:
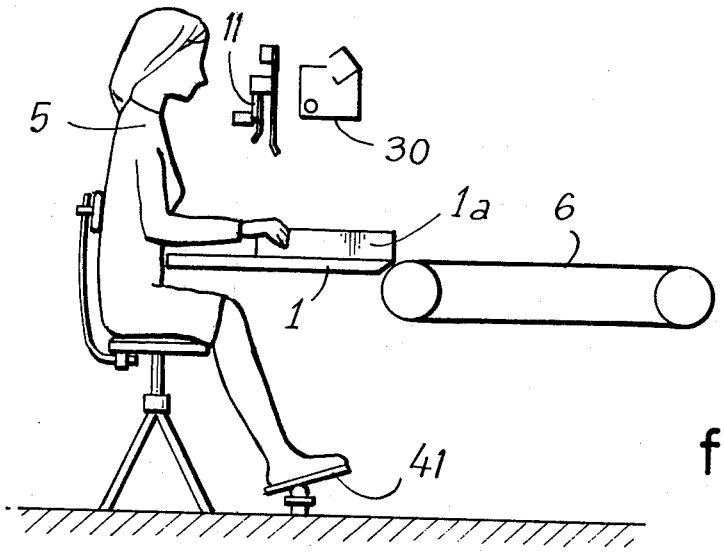
FIG. 3 is a side view of the working station of the installation of FIG. 1.
Figure 4:
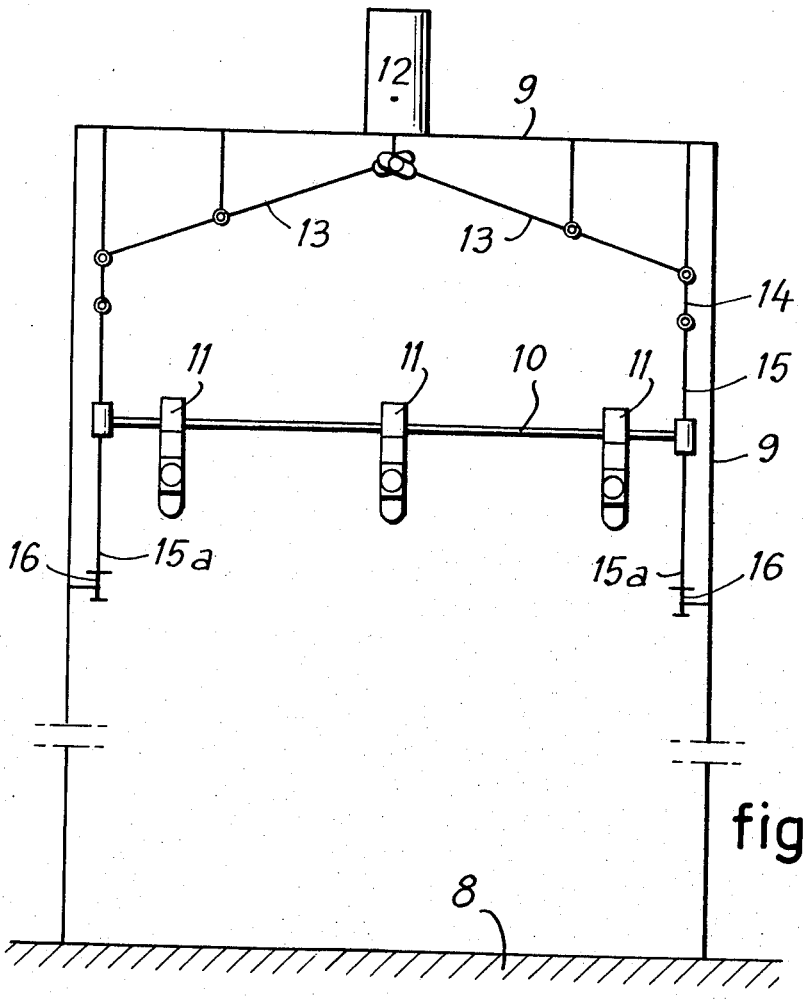
FIG. 4 is a schematic view in elevation of the device for preparing the supply installation of FIG. 1, according to an embodiment of the invention.

The aim of the preparation device is to maintain in a fixed predetermined position with respect to the chassis 8 of the installation, elements 3 and 4 which have been adjusted by hand, and to facilitate this adjustment (FIG. 4). To this end, this preparation device is located in a vertical plane facing the operator, substantially at eye level (FIG. 3). This vertical arrangement facilitates the adjustment of the elements to be joined, their engagement in the device as well as their drive by the transfer system.

As shown schematically in FIG. 4, the preparation device comprises a vertical support frame 9 fast with the frame 8 of the joining machine and a horizontal crosspiece 10 which carries vertical clips 11 and which is guided on the frame so as to be able to move vertically. The crosspiece 10 is determined by adjustable stops 16 which, by acting on the lower end 15*a* of the tie rods 15, limit the descent of the crosspiece 10. The jack 12, as well as the other jacks 17, 34, 36, 39, and 60 are all pressure-activated devices comprising a housing with a piston therein having an activating rod emerging from the housing and carried by the piston. One pneumatic line enters the housing below the piston, and one above the piston. By alternately energizing the pneumatic lines, the piston can be extended or retracted to thereby actuate different devices.

The main members of the preparation device are the automatic clips 11. The number of these clips depends on the length of the elements 3, 4 to be maintained and their nature. The distance between two consecutive clips 11 is typically included between 10 and 30 cm.

Figure 5A:
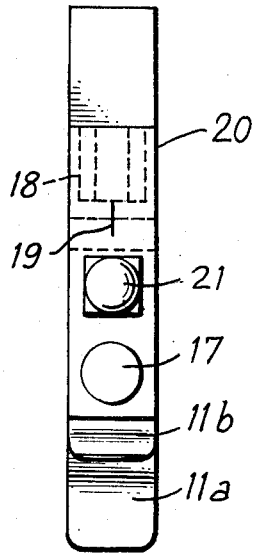
FIG. 5*a* is a front view of an automatic clip of the preparation device of FIG. 4, according to one embodiment of the invention.
Figure 5B:
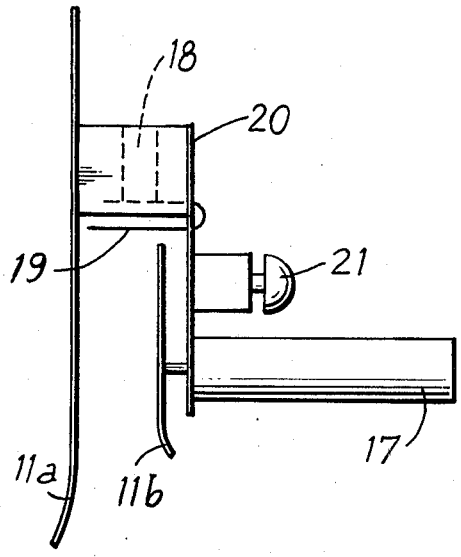
FIG. 5*b* is a side view of the clip shown in FIG. 5*a;*
Figure 6:
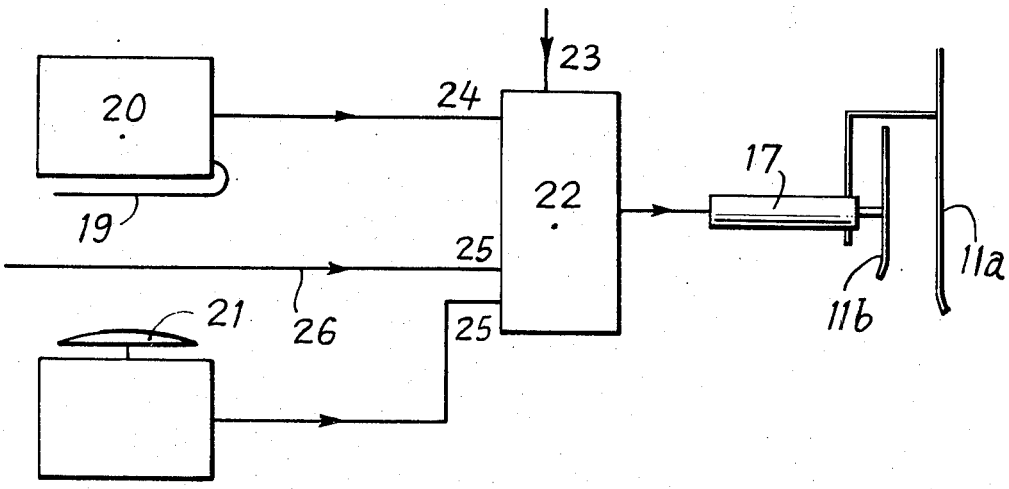
FIG. 6 is a block diagram of the device for controlling a clip of the preparation device according to one embodiment of the invention.

As may be seen in FIGS. 5*a* and 5*b*, these clips 11 comprise two parallel jaws 11*a*, 11*b*. One of the jaws 11*a* is fixed and serves to position the elements 3 and 4 in depth; the other jaw 11*b* is mobile and insures tightening; this jaw 11*b* is actuated by a jack 17. The positioning of the elements 3 and 4 in height is obtained by a stop 18 associated with a pick-up instantaneously initiating closure of the clip 11. This pick-up comprises a probe 19 of reduced stroke, connected to a pneumatic or electric switch 20 (FIG. 6). Alternately, the position of the elements 3 and 4 in the clip 11 may also be detected photoelectrically (light barrier). The stop-pick up assembly 18 and 20 ensures the precise and reproducible positioning of the elements 3 and 4 to be joined.

The clips 11 must receive an order for opening, either from the transfer device described hereinbelow, in order to release the elements 3, 4 when they are tripped by said latter device, or from the operator by means of a knob 21 to enable said operator to correct the position of the elements 3, 4 engaged in a clip 11.

As shown in FIG. 6, the device for controlling the clips 11 comprises a distributor 22 which receives at 23 the compressed air serving to control the jack 17. The order for closure coming from the pick-up 19 is applied at 24 to this distributor 22; the order for opening applied at 25 is given either by the common control to all the clips by means of connection 26, or by the correction knob 21. In this regard, each clip 11 is controlled or actuated by a cylinder 17, which in turn corresponds to a knob 21. By actuating the knob 21, only the clips corresponding to that knob are open. In contrast, by applying a control signal through the connection 26, all of the clips 11 open.

The aim of the transfer device is to grip the elements 3 and 4 held by the preparation device 9 to 26, in order:

on the one hand, to release said preparation device and allow the following elements 3, 4 to be joined to be immediately positioned in said preparation device, on the other hand, to transfer these elements 3, 4 up to a drive device 27 and 28 of an automatic assembling machine 29 (FIG. 1).

Figure 2:
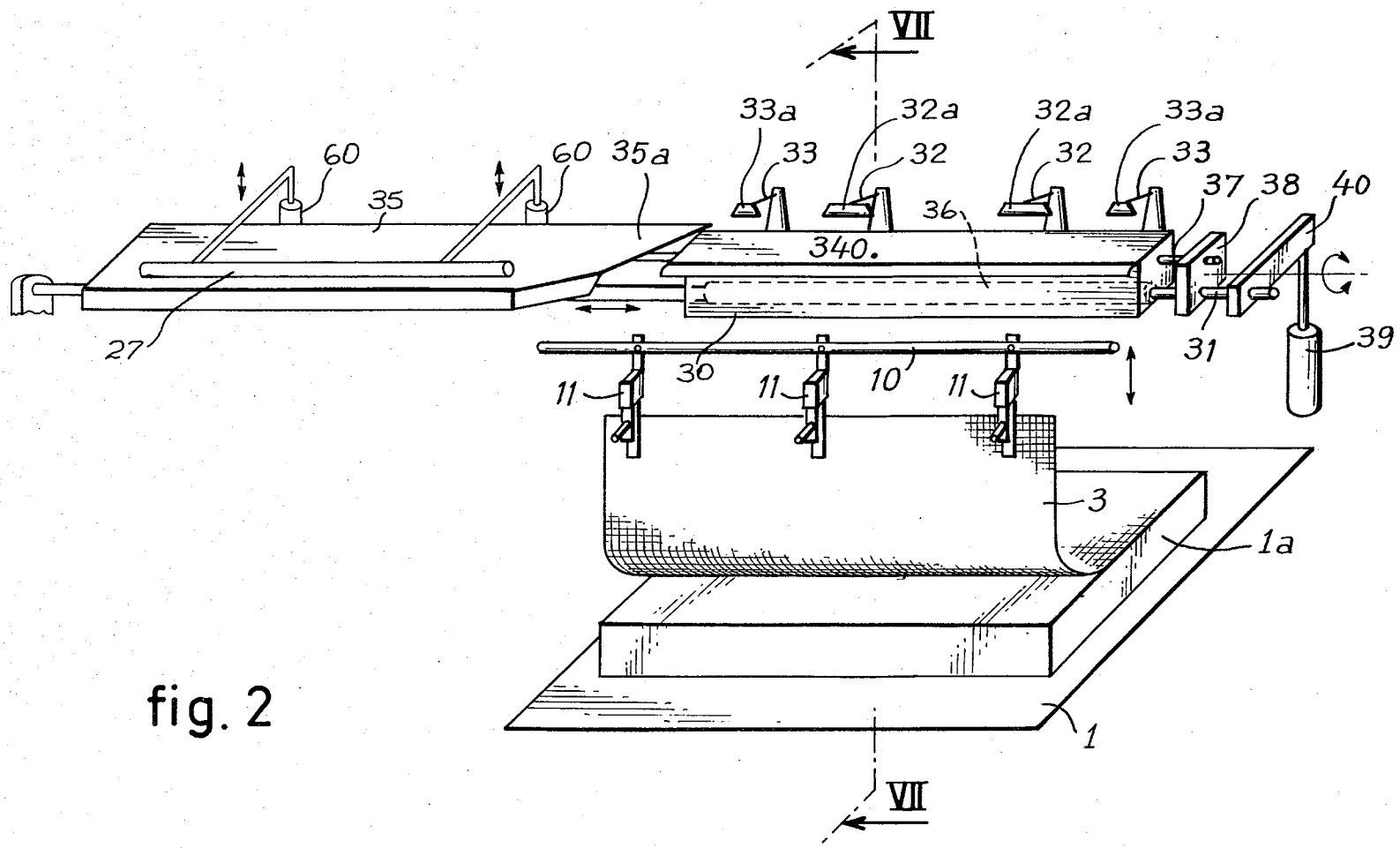
FIG. 2 is a partial view in perspective of the installation of FIG. 1.
Figure 7:
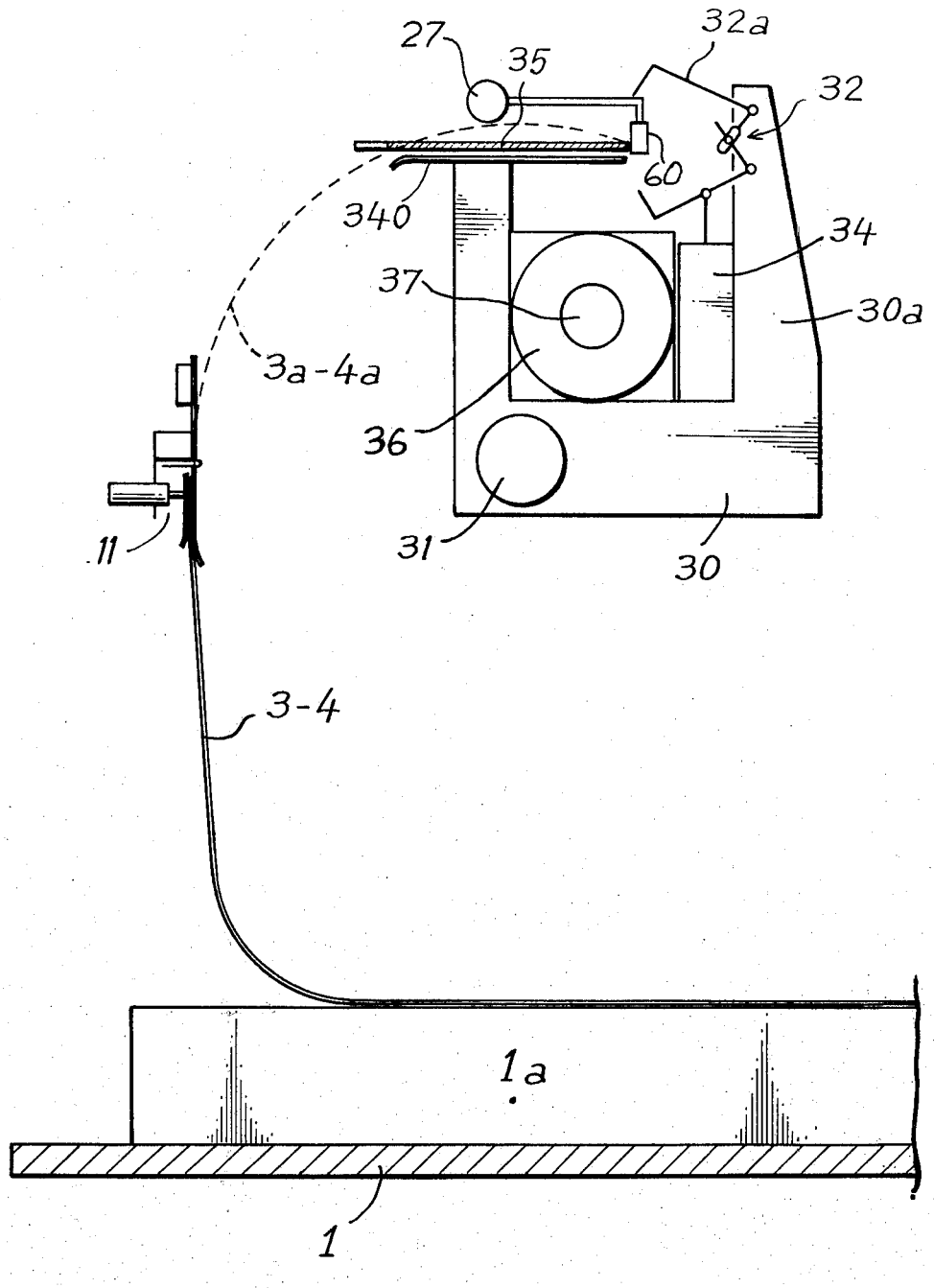
FIG. 7 is a vertical section along VII—VII of FIG. 2, showing the transfer device of the supply installation, according to one embodiment of the invention.

This transfer device, shown schematically in perspective in FIG. 2 and in section in FIG. 7, comprises a carriage 30 which may pivot about and slide axially on a horizontal shaft 31 which may rotate about its longitudinal direction but not move axially. The carriage 30 carries at the upper end of arms 30*a*, clips 32 and 33 each controlled individually by a jack 34. The number of the clips of the carriage 30 is greater by one unit than that of the clips 11 of the preparation device. The end clips 33 are located, when the elements 3, 4 are taken, to the outside of and very close to clips 11. The clips 33 have jaw 33*a* of reduced width (1 to 2 cm) smaller than that of the jaws 32*a* of the intermediate clips 32.

The intermediate clips 32 taken the joined elements 3, 4 substantially at the center of the gap between two adjacent clips 11 of the preparation device. The jaws 32*a* of these clips 32 are of larger width (5–10 cm) in order to hold the elements 3, 4 to be transferred, to avoid any distortion of the elements 3, 4 when placed between the clips 32. The carriage 30 is provided with a plate 340 located slightly below the plane of grip of the clips 32, 33. This plate 340 facilitates the transfer of the elements 3, 4 held in the clips 32, 33 on a table 35 of the automatic joining machine. To facilitate transfer of the elements 3, 4, the plate 340 slides under the table 34, the end 35*a* of which, adjacent the working station, is on the slant, this facilitating the passage of the elements 3, 4 without deformation. The displacement of the carriage 30 between the working station and the table 35 of the automatic machine is controlled by a jack 36 with a through rod 37, said carriage 30 sliding along and on shaft 31.

The rod 37 of the jack 36 is axially connected to the shaft 31 by a support piece 38.

To grip the elements 3 and 4 fixed in the preparation clips 11, the carriage 30 pivots forward on the shaft 31. This pivoting is controlled by the rotation of the shaft 31 which is obtained by the action of a jack 39 on a radial arm 40 rotating with the shaft 31. The rotation of the shaft 31 is transmitted to the carriage 30 by means of the piece 38 keyed on the shaft 31 and fixed to the rod 37 of the jack 36.

The installation which has just been described functions as follows.

The supply operations are subdivided into two groups: preparation and transfer.

The preparation takes place as follows.

The operator grips the two elements 3 and 4 to be joined, one in each hand. He/she adjusts these elements 3, 4 by superposing the two upper left-hand corners in two's and introduces them, adjusted, in the first preparation clip 11. After having transferred his/her hands to the right end of the two elements 3, 4, he/she adjusts the two right-hand corners, then, having gripped in the left-hand the center of the two elements 3, 4 the operator introduces them simultaneously in the two other clips 11 of the preparation device. The first two elements 3, 4 to be joined being thus positioned in the preparation device, the operator controls their transfer by pressing on a pedal 41 (FIG. 3) and then grips the following two elements 3, 4.

The transfer takes place as follows.

It comprises two separate phases: the gripping of elements 3 and 4 to be transferred and their transport.

The grip:

The transfer carriage 30 pivots forwardly, clips 32, 33 open. The clips close at the end of pivoting stroke of the carriage 30, and grip the adjusted elements 3, 4. The preparation clips 11 then open and retract upwardly so as to move away from the path 3*a*, 4*a* of the superposed elements 3, 4 gripped by the clips 32, 33 and moved during the rearward pivoting of the carriage 30 (FIG. 7). The transfer carriage 30 pivots rearwardly, lifting elements 3, 4 to be joined. By its rearward rotation, it raises the elements 3, 4 from the stack 1*a* and shifts them rearwardly (towards the right in FIG. 7) so as to move them away from the preparation clips 11 which, after descent of their support 10, are again available for engagement with the following elements 3, 4. The clips have been removed from their respective stack 1*a*, 2*a* and adjusted with respect to each other during this automatic gripping operation.

The transport:

The carriage 30, having terminated its rearward rotation, moves towards the automatic assembling machine 29, placing the adjusted elements 3, 4 to be joined, on the table 35 of the automatic machine. At the end of stroke, the carriage 30 initiates the lowering of the transport system 27, 28 of the automatic machine, the opening of the transfer clips 32, 33 and the return of the carriage 30 to its initial position as shown in FIGS. 1 and 2. Regarding the details of the transport system 27, 28 of the present invention, the system may be similar to many conventional systems found in the prior art. In FIGS. 1, 2 and 7, it is shown that members 27 and 28 are presser bars activated by the jack 60 (shown also in FIG. 8). These pressure bars or pinching elements are lowered into position by the jack 60 against the elements 3, 4 to allow release of the clips 32 and 33. As is well-known in the art, a feed dog in the sewing machine 29 pulls the elements along the table 25 for a joining or sewing operation.

The automatic assembling machine is constituted by the actual joining machine 29, drive devices 27 and 28 and a unit for evacuating the joined elements 3, 4, this unit being constituted by a stacker 42 and an evacuator (belt 43) which allows the evacuation of the stacks of joined elements 3, 4 either definitively or towards the working station again, for the joining of a second side, for example.

The different operations described hereinabove are controlled successively by the end of the execution of the preceding operation. When two operations are to succeed each other very quickly, the information which serves to control the first operation is repeated with a delay for the execution of the second operation.

Figure 8:
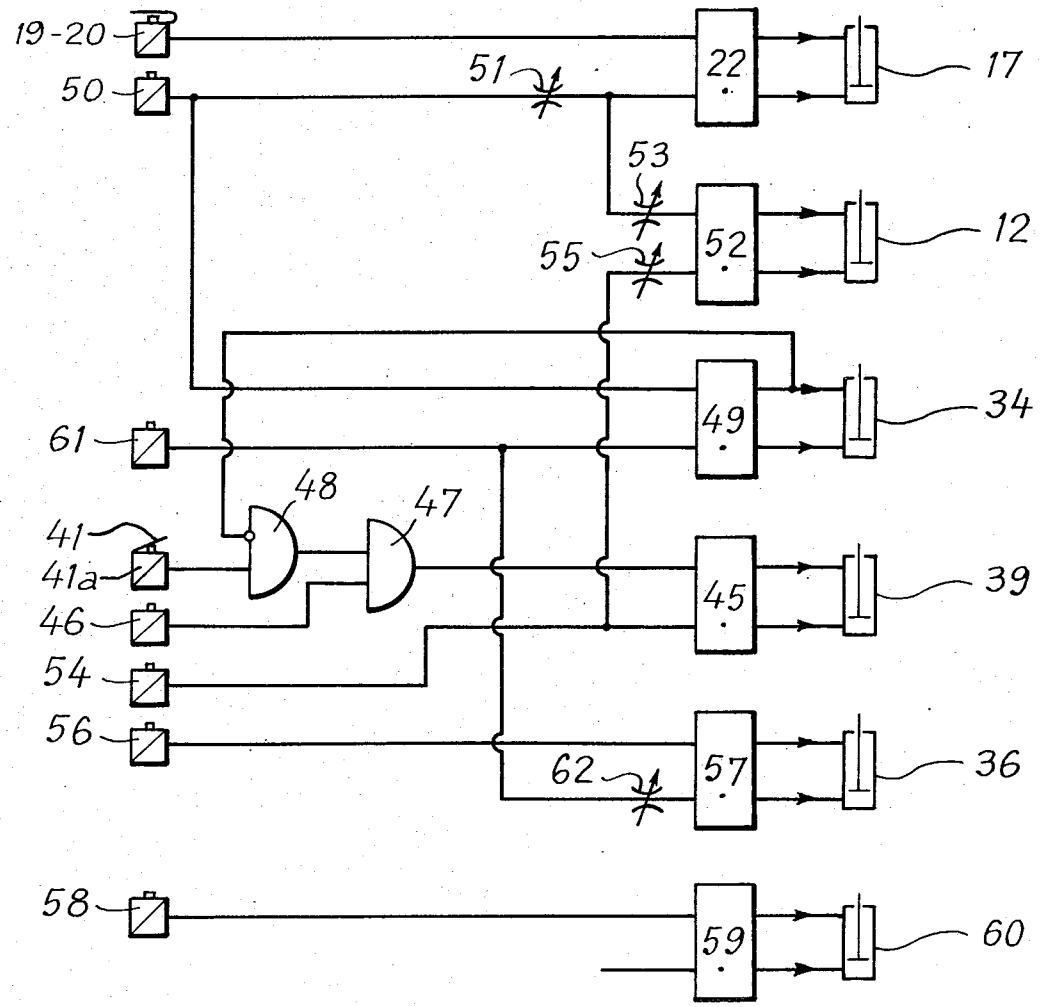
FIG. 8 is a block diagram of the control circuit of the supply installation according to one embodiment of the invention.
Figure 9:
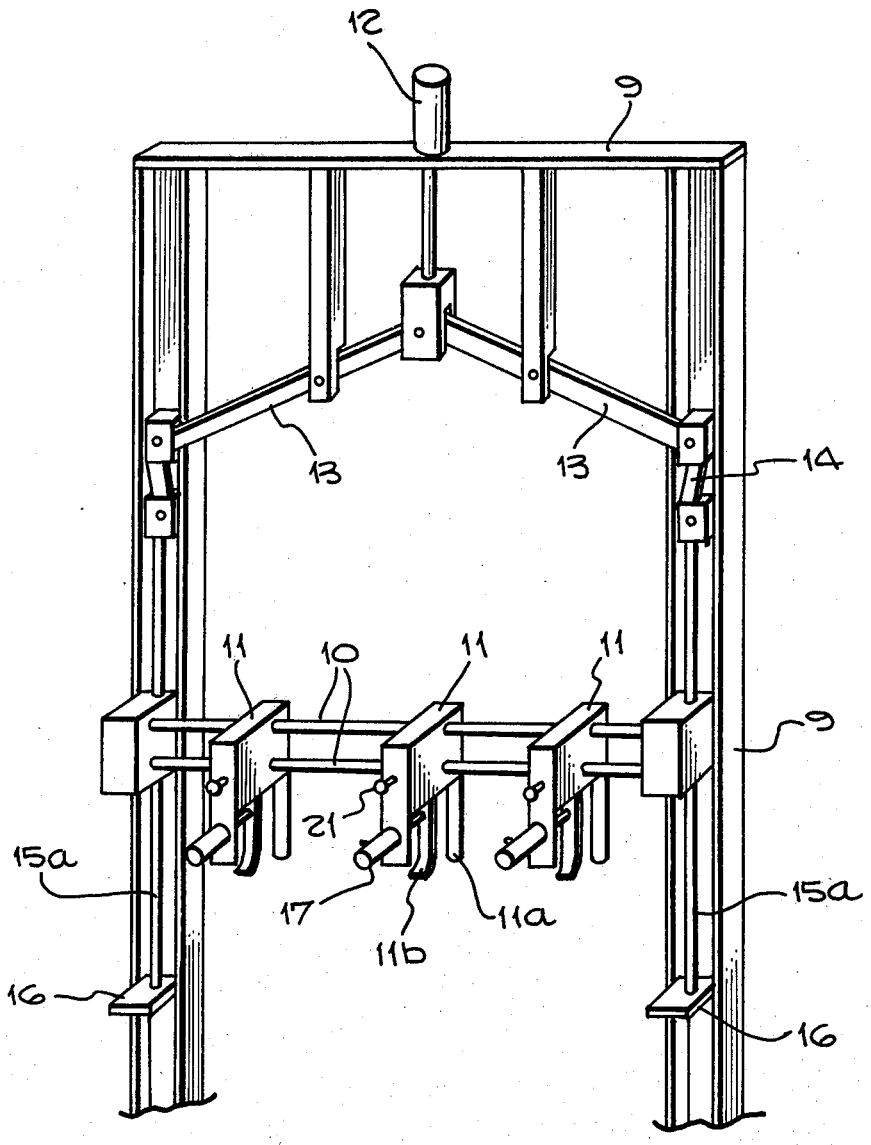
FIG. 9 is a perspective view of the device for preparing the supply installation of FIG. 1, said device being shown schematically in FIG. 4.

The diagram shown in FIG. 8 represents an embodiment of a control circuit of the supply installation described hereinabove. To the left of this diagram are shown pick-ups which deliver the information and to the right, distributors which control the different power members. The connections figure between the two.

This circuit functions as follows.

The arrival of the superposed elements 3, 4 in abutment on 18 in each preparation clip 11, triggers, by means of a pick-up 19–20 and a distributor 22, the closure of said preparation clip 11 by the jack 17. When all the preparation clips 11 are provided with elements 3, 4, the operator controls the beginning of the transfer cycle, by means of pedal 41.

The first operation of this cycle is the rotation in the forward direction of the carriage 30 controlled by a distributor 45. This rotation is possible only if the carriage 30 is in its so-called gripping position; i.e., a position for which this carriage 30 is opposite the preparation device 9 to 21. This position is monitored by an end of stroke pick-up 46 of which the information is transmitted, together with that from the pick up 41*a* associated with the pedal 41, to the distributor 45, by means of an AND gate 47. Moreover, this forward rotation of the carriage 30 is allowed only if the transfer clips 32, 33 are open; the control signal issuing from pedal 41 is transmitted by a NO gate 48 only if a distributor 49 holds the clips 32, 33 open.

The end of forward rotation of the carriage 30 triggers, via an end of stroke pick up 50 and the distributor 49, the closure of the transfer clips 32, 33 by means of the jacks 34; then, with a delay element 51, this end of forward rotation of the carriage 30 triggers the opening of the preparation clips 11 by means of the distributor 22, which opening is followed by the retraction of the preparation system 10, 11; this retraction is controlled by a distributor 52 with a delay due to a delay element 53 after the opening of the preparation clips 11.

The end of the retraction of the preparation system 10, 11 noted by a pick-up 54, controls the rearward rotation of the carriage 30 by means of the distributor 45, then, with a delay due to a delay element 55, the descent of the preparation system 10, 11 by means of jack 12.

The end of the rearward rotation of the carriage 30 triggers, by means of a pick-up 56 and a distributor 57, the displacement of the carriage 30 towards the automatic joining machine 27, 28, 29, by means of the jack 36.

The end of transfer stroke of the carriage 30 controls, by means of a pick-up 58 and a distributor 59, the lowering of the transport system 27, 28 of the automatic machine, by means of a jack 60.

The end of lowering of this device 27, 28 acts on a pick-up 61 which provokes, by means of the distributor 49, the opening of the preparation clips 11 and with a delay due to an element 62, the return of the carriage 30 to its initial position as shown in FIGS. 1 and 2.

Thus, the clips 11 of the preparation device are aligned horizontally along the crosspiece 10 so as to present a vertical plane of grip common to the three clips 11 and parallel to the axis 31. The jaws 11*a* and 11*b* of the clips 11, have their free ends turned downwardly, so that the introduction into the clips 11 of the superposed elements 3, 4 to be joined is effected from the bottom. The stops 18 of the clips 11 are aligned horizontally.

The clips 32 and 33 of the transfer device are aligned horizontally and parallel to the pivot axis 31 of the carriage 30. The jaws 32*a* and 33*a* of these clips 32, 33, which have their free ends turned in the direction of forward pivoting of the carriage 30, also have a common plane of grip parallel to shaft 31; this latter is positioned on the chassis 8 of the installation so as to be situated at an equal distance from the common plane of grip of the clips 11 and that of the clips 32, 33.

It should be noted that the shaft 31 is advantageously located at a level slightly higher than that of the preparation clips 11, as shown in FIG. 7, so that the clips 32 and 33 as well as the carriage 30 in rest position as shown in FIG. 7, are at a level higher than that of clips 11, constituting the first gripping device, and to the rear thereof with respect to the operator 5.

It should also be noted that the stack 1*a* of the flexible element 3 is located in front of the operator 5 and substantially perpendicular to the first gripping means 11.

The method and installation which have just been described may also be suitable for effecting an operation on a single piece, for example, a serging on a piece of material. In this case, it is not a question of joining two pieces, but of running a seam along the edge of one piece to avoid fraying of the edge of the piece of material. All the elements of the installation are necessary for effecting this operation: positioning by means of the clips 11 of a gripping zone of the piece in a first predetermined fixed position, by means of the transfer device; finally, gripping of the piece by the drive device of the sewing machine constituted by the joining machine 29.

What we claim is:

1. A method for supplying elements to a joining machine having a tool for joining at least two flexible elements such as textile pieces and a drive device for moving elements to said tool, comprising the sequential steps of:

(a) manually superposing at least partially said flexible elements so that a predetermined joining zone of one of said elements is superposed with a predetermined joining zone of the other element;

(b) manually presenting said superposed elements to a first predetermined fixed place;

(c) gripping said overlapping zone of said superposed elements at said first predetermined fixed place with a first gripping device;

(d) moving said gripped elements to a second predetermined place with said first gripping device;

(e) gripping said elements at said second predetermined place with a second gripping device;

(f) releasing the flexible elements from said first gripping device;

(g) repositioning said first gripping device to said first predetermined position;

(h) rotating said second gripping device, with said elements therein away from said first gripping device; and (i) transporting said elements with said second gripping device to said drive device.

2. A method for supplying a treating machine having a tool for linear treatment of flexible elements such as textile pieces and a drive device for moving said elements to said tool, comprising the steps of:

(a) manually positioning and maintaining a gripping zone of at least one element at a first predetermined fixed place;

(b) gripping said element at said zone with a first gripping device;

(c) vertically transporting the flexible element by means of said first gripping device until said zone occupies a second predetermined fixed place;

(d) gripping said zone with a second gripping device at said second predetermined place, and releasing said element from said first gripping device; and, (e) moving said element with said second gripping device to said drive device.

3. An installation for supplying a machine for linearly joining flexible elements such as textile pieces, said machine having a tool and a drive device for moving said elements to said tool, said installation comprising:

(a) a working station in which an operator may take his place;

(b) positioning and gripping means for gripping a gripping zone of two at least partially superposed fixed elements at a first predetermined place and for moving said elements to a second predetermined place, said positioning and gripping means comprising a support on which are mounted locking members spaced apart from one another and adapted each to grip a respective point of said gripping zone, each locking member being associated with detection means placed substantially at the location of said locking member and adapted to cooperate with an edge of said gripping zone in order to control the closing of said locking member when said edge passes beyond a predetermined position; and (c) transporting means for movement between said second predetermined place and said drive device for taking said flexible elements from said gripping means at said second predetermined place and for transporting them to said drive device.

4. A supply installation as defined in claim 3 wherein said positioning and gripping means is located in front of the operator, substantially at eye level.

5. A supply installation as defined in claim 3 wherein said transporting means is located at a level higher than that of said positioning and gripping means and to the rear thereof with respect to the operator placed at said working station.

6. A supply installation as defined in claim 3 wherein it further comprises two supports each supporting a stack of flexible elements to be joined, one of the supports being disposed so that the stack which it supports is located in front of the operator and substantially perpendicular to said positioning and gripping means.

7. A supply installation as defined in claim 3 wherein said locking members of said positioning and gripping means are adapted to maintain said locations of the gripping zone in a common vertical plane.

8. A supply installation as defined in claim 7 wherein said carriage of the transporting means is movable, on the one hand, in rotation about a horizontal axis parallel to the line of distribution of the locking members of the positioning and gripping means and, on the other hand, in translation parallel to this axis of rotation.

9. A supply installation as defined in claim 3 or claim 7 wherein said locking members of said positioning and gripping means are clips all having the same vertical plane of clamping and the jaws of which have their free ends turned downwardly, said clips being distributed along a horizontal line.

10. An installation for supplying a machine for linearly joining flexible elements such as textile pieces, said machine having a tool and a drive device for moving said elements to said tool, said installation comprising:

(a) positioning and gripping means for gripping a gripping zone of two at least partially superposed fixed elements at a first predetermined place and for moving said elements to a second predetermined place;

(b) transporting means for movement between said second predetermined place and said drive device for taking said flexible elements from said gripping means at said second predetermined place and for transporting them to said drive device, said transporting means comprising a carriage supporting at least one locking member, said carriage being mounted on the chassis for displacement between said second predetermined place, at which said locking member is in register with said gripping means, and a position at which said locking member is in register with the drive device of the machine, said locking member of said transporting means being a clip which is positioned so as to be located outside said locking members of said positioning and gripping means, when said carriage is in said second predetermined position.

* * * * *